US006497565B2

(12) United States Patent
Inaguma et al.

(10) Patent No.: US 6,497,565 B2
(45) Date of Patent: Dec. 24, 2002

(54) PUMP APPARATUS HAVING DRIVE FORCE INPUT PORTION ALIGNED WITH PUMP SHAFT BEARING MEMBER

(75) Inventors: Yoshiharu Inaguma, Nagoya (JP); Susumu Honaga, Hoi-gun (JP)

(73) Assignee: Toyoda Koki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/870,794

(22) Filed: Jun. 1, 2001

(65) Prior Publication Data

US 2002/0012597 A1 Jan. 31, 2002

(30) Foreign Application Priority Data

Jul. 26, 2000 (JP) ..... 2000-225496

(51) Int. Cl.[7] ..... F04C 2/344; F04C 15/00
(52) U.S. Cl. ..... 418/259; 418/270; 417/362
(58) Field of Search ..... 417/362; 418/55.1, 418/259, 270; 474/70, 76, 197, 199

(56) References Cited

U.S. PATENT DOCUMENTS 4,890,987 A * 1/1990 Sato et al. ..... 418/55.1
4,898,526 A * 2/1990 Sakamaki et al. ..... 418/259
5,664,941 A * 9/1997 Bearint ..... 418/259
5,795,137 A * 8/1998 Ozawa et al. ..... 417/362

* cited by examiner

*Primary Examiner*—John J. Vrablik
(74) *Attorney, Agent, or Firm*—Oblon, Spivak, McClelland, Maier & Neustadt, P.C.

(57) ABSTRACT

In a pump housing of a pump apparatus, a pump shaft is rotatably supported by two bearings and is connected to a pump unit. A rotary drive member is fixed to one end of the pump shaft projecting from the tip end portion of the housing. The rotary drive member includes a boss portion fixed to the one end of the pump shaft projecting from the housing, and a rim portion integral with the boss portion. The rim portion is offset from the boss portion to cover at least a portion of the tip end portion of the housing. A groove portion for receiving a drive belt is formed on the outer circumference of the rim portion. The widthwise center plane of the groove portion is located between the respective centers of the two bearings. In place of the groove portion, a tooth portion engageable with a drive gear may be formed on the outer circumference of the rim portion. Preferably, the pump unit is of a balanced vane type.

6 Claims, 4 Drawing Sheets

PUMP APPARATUS HAVING DRIVE FORCE INPUT PORTION ALIGNED WITH PUMP SHAFT BEARING MEMBER

INCORPORATION BY REFERENCE

The disclosure of Japanese Patent Application No. 2000-225496 filed on Jul. 26, 2000 is incorporated herein by reference in this entirety.

BACKGROUND OF THE INVENTION

1. Field of the Invention

The present invention relates to a pump apparatus of relatively small size, and more particularly to an improvement on the structure of a pump shaft drive portion of a pump apparatus.

2. Description of the Related Art

FIG. 1 shows a conventional compact pump apparatus for supplying operation fluid to a power steering apparatus of a vehicle. In the pump apparatus, a pump shaft 2 for driving a pump unit 5 disposed within a housing 1 is supported by a ball bearing 3 and a slide bearing 4; and a pulley 9 is fixed to one end of the pump shaft 2 projecting from the housing 1. A groove portion 9a is formed on the outer circumference of the pulley 9, around which a drive belt (not shown) is wound in order to transmit rotation of an engine of the vehicle to the pump shaft 2. As a result, the pump unit 5 is operated, so that operation fluid sucked from an inlet port 6 into the interior of the pump unit 5 is discharged from an outlet port 8 via a pressure chamber 7. Generally, the pump unit 5 is a balanced-type vane pump. In such a balanced-type vane pump, a plurality of (typically, two) suction ports are provided at symmetric positions; and a plurality of (typically, two) discharge ports are provided at symmetric positions. Therefore, radial forces generated within the pump unit 5 are cancelled out, so that almost no net load acts on the pump shaft 2. Accordingly, when merely the pump unit is considered, only one end of the pump shaft 2 is required to be supported by use of a bearing having a small load capacity.

However, since a large tension is applied to the drive belt in order to prevent slippage, the following problem occurs. That is, a large tensile force W1 acts on the pump shaft 2 perpendicularly at a position corresponding to a center plane L1 of the drive belt wound around the groove portion 9*a* of the pulley 9. Since the center plane L1 is located on the tip end side with respect to the ball bearing 3, a moment which inclines the pump shaft 2 is produced, and a force greater than the tensile force W1 acts on the ball bearing 3. Therefore, the ball bearing 3 must have a large load capacity; and the distance between the two bearings 3 and 4 must be increased. Therefore, the size of the bearing support portion of the housing 1 increases. This problem of the bearing support portion of the housing 1 having a large size is always present even in the case where both the bearings 3 and 4 are formed of ball bearings or slide bearings, or in the case where the bearings 3 and 4 are replaced with a single long slide bearing.

FIG. 2 shows another conventional pump apparatus of a compact type. In the pump apparatus, opposite ends of a pump shaft 11 for driving a pump unit 14 are supported by slide bearings 12 and 13, which are provided within a housing 10 to be located on the front and rear sides, respectively, of the pump unit 14; and a gear 17 is fixed to one end of the pump shaft 11 projecting from the housing 10. Rotation of an engine of the vehicle is transmitted to the gear 17 via a drive gear in meshing-engagement with a tooth portion 17*a* of the gear 17. Thus, the pump shaft 11 is rotated to drive the pump unit 14, whereby operation fluid sucked from an inlet port 15 into the interior of the pump unit 14 is discharged from an outlet port (not shown) via a pressure chamber 16.

In the conventional pump apparatus shown in FIG. 2, since the two slide bearings 12 and 13 for supporting the opposite ends of the pump shaft 11 are attached to two members which are fixed to each other by use of bolts, aligning the center axes of the slide bearings 12 and 13 is difficult, so that smooth rotation of the pump shaft 11 cannot be expected. Therefore, the conventional pump apparatus shown in FIG. 2 has drawbacks of increased frictional torque and generation of vibration and noise.

SUMMARY OF THE INVENTION

In view of the foregoing, an object of the present invention is to provide a pump apparatus which can solve the various problems involved in conventional pump apparatuses.

To achieve the above-object, the present invention provides a pump apparatus which is driven by drive force from a drive source, comprising a housing; a bearing member provided within a tip end portion of the housing; a pump shaft rotatably supported by the bearing member, one end of the pump shaft projecting from the tip end portion of the housing; a pump unit accommodated within the housing and operated through rotation of the pump shaft; and a drive member fixed to the one end of the pump shaft projecting from the housing and adapted to transfer drive force from the drive source to the pump shaft. The drive member includes a drive force input portion to which the drive force is transferred from the drive source. The center of the bearing member in the axial direction of the pump shaft coincides with-the center of the drive force input portion in the axial direction of the pump shaft.

Preferably, the drive member includes a boss portion fixed to the one end of the pump shaft projecting from the housing, and a rim portion integral with the boss portion, the rim portion being offset from the boss portion to cover at least a portion of the tip end portion of the housing; and the drive input portion is formed on the outer circumference of the rim portion.

Preferably, the bearing member consists of two bearings disposed adjacent to each other; and the center of the drive force input portion in the axial direction of the pump shaft is located between the respective centers of the two bearings in the axial direction of the pump shaft.

The drive force input portion may be a groove portion which is engaged with a drive belt extended between and wound around the groove portion and a pulley of the drive source. In this case, the center of the groove portion in the axial direction of the pump shaft is located between the respective centers of the two bearings in the axial direction of the pump shaft.

The drive force input portion may be a tooth portion which is in meshing-engaged with a drive gear of the drive source. In this case, the center of the tooth portion in the axial direction of the pump shaft is located between the respective centers of the two bearings in the axial direction of the pump shaft.

Preferably, the pump unit is a vane pump. More preferably, the vane pump is a balanced-type vane pump having a plurality of suction ports disposed symmetrically with respect to the pump shaft and a plurality of discharge ports disposed symmetrically with respect to the pump shaft.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which.

DESCRIPTION OF THE PREFERRED EMBODIMENTS

Figure 3:
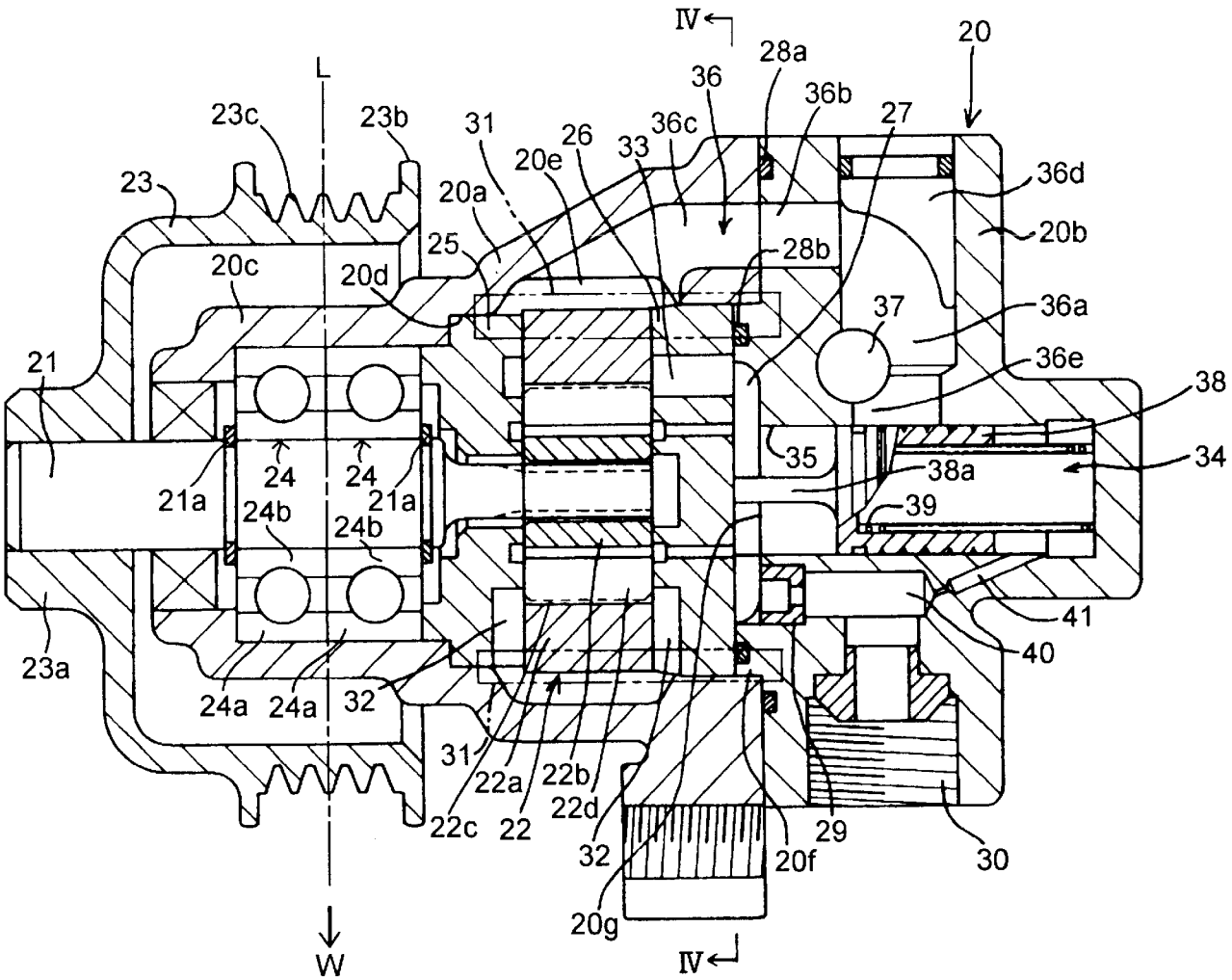
FIG. 3 is a vertical cross-sectional view of a pump apparatus according to a first embodiment of the present invention.
Figure 4:
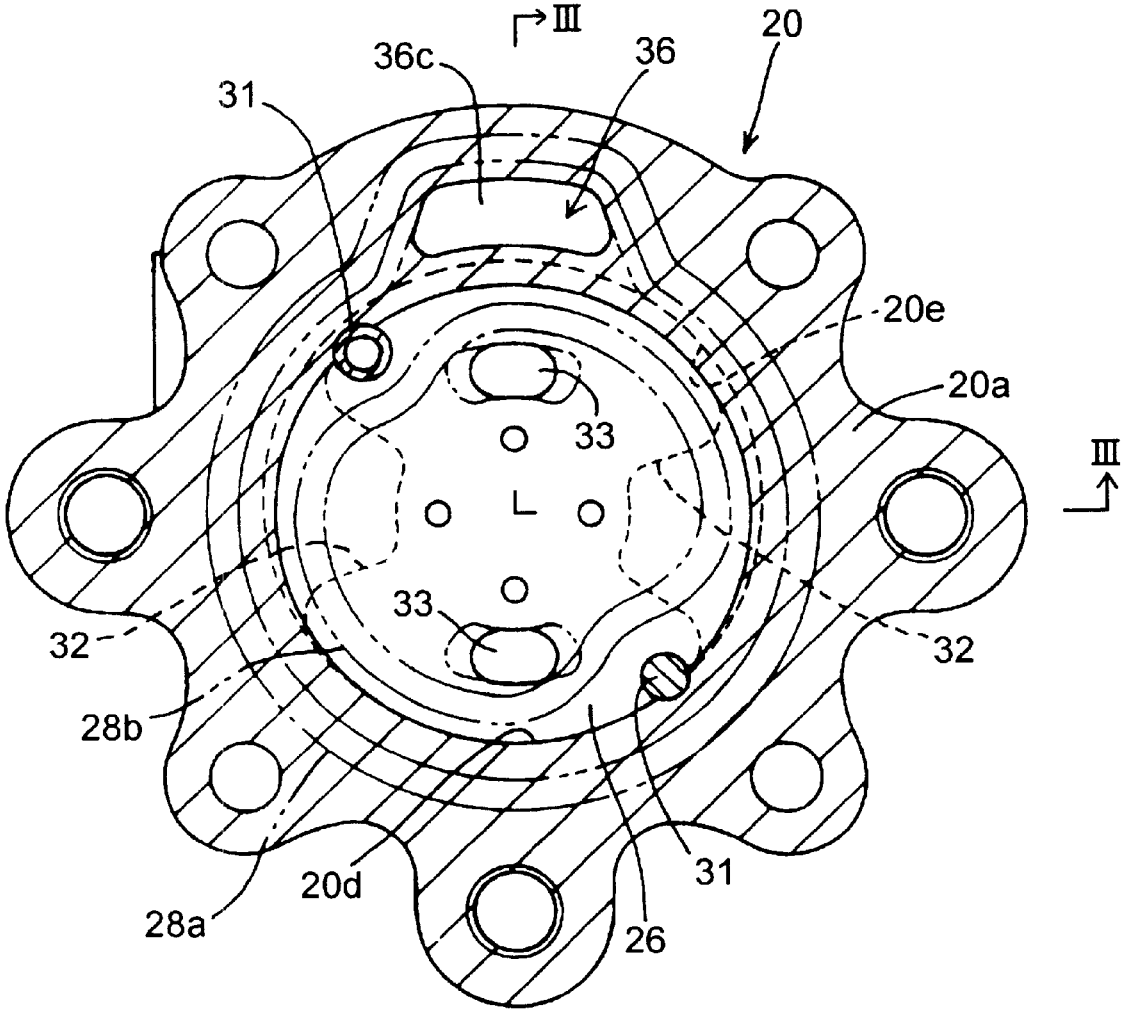
FIG. 4 is a cross-sectional view taken along line IV—IV in FIG. 3.

First, a pump apparatus according to a first embodiment of the present invention will be described with reference to FIGS. 3 and 4. The pump apparatus comprises, as main components, a housing 20, a pump shaft 21 rotatably supported by the housing 20, a pump unit 22 provided within the housing 20 and driven through the pump shaft 21, and a pulley (rotary drive member) 23 coaxially fixed to one end of the pump shaft 21.

The housing 20 consists of a front housing 20*a* and a rear housing 20*b* fixed to the rear side of the front housing 20*a* by use of bolts. A substantially cylindrical tip end portion 20*c* is formed at one end of the front housing 20*a*. The outer races 24*a* of two ball bearings 24 are fitted into and supported by the inner circumferential surface of the tip end portion 20*c* in such a manner that the outer races 24*a* are located adjacent to each other. The pump shaft 21 is fitted into and supported by the inner races 24*b* of the ball bearings 24. Axial movement of the inner races 24*b* is restricted by two snap rings 21*a*. A stepped cylindrical inner space 20*d* is formed within the front housing 20*a* to be coaxial with the pump shaft 21. An annular fluid-passage space 20*e* is eccentrically formed at an intermediate portion of the inner space 20*d* in the axial direction of the pump shaft 21. A front side plate 25 and a rear side plate 26 each assuming a disk-like shape are sildably fitted into front and rear portions, respectively, of the inner space 20*d*. The pump unit 22, which will be described later, is disposed between the front side plate 25 and the rear side plate 26.

The rear housing 20*b* has a cylindrical portion 20*f* formed on the front face thereof. The cylindrical portion 20*f* is fitted into the inner space 20*d* of the front housing 20*a* to face the rear face of the rear side plate 26 with a slight clearance formed therebetween. A depression 20*g* formed on the front face of the cylindrical portion 20*f* defines a pressure chamber 27 in cooperation with the rear face of the rear side plate 26. An O-ring 28*a* is interposed between the front housing 20*a* and the rear housing 20*b* in order to implement a fluid-tight seal therebetween. An O-ring 28*b* is interposed between the rear side plate 26 and the cylindrical portion 20*f* of the rear housing 20*b* in order to implement a fluid-tight seal around the pressure chamber 27. The pressure chamber 27 communicates with an outlet port 30 having a metering orifice 29.

The pump unit 22 located between the front side plate 25 and the rear side plate 26 is a vane pump which consists of a cam ring 22*a*, a rotor 22*b*, and a plurality of vanes 22*d*. The cam ring 22*a* is fixed to the front housing 20*a*. A cam surface having a generally elliptical cross section is formed on the inner wall of the cam ring 22*a*. The rotor 22*b* is coupled with the inner end of the pump shaft 21 to be rotated thereby. The vanes 22*d* are slidably accommodated in radial slits 22*c* formed in the rotor 22*b*, and the radially outer ends of the vanes 22*d* are always in contact with the cam surface of the cam ring 22*a*. The O-ring 28*b* elastically presses the rear side plate 26 toward the rear face of the cam ring 22*a* of the pump unit 22, so that the cam ring 22*a* is sandwiched between the front and rear side plates 25 and 26 and held in place by pressure produced from elastic force. The cam ring 22*a* is located within the width of the passage space 20*e* with respect to the front/back direction. The cam ring 22*a* and the side plates 25 and 26 are supported by two positioning pins 31 (see FIG. 4), which extend parallel to the axis of the pump shaft 22, whereby the cam ring 22*a* and the side plates 25 and 26 are positioned in the circumferential direction relative to the front housing 20*a*.

A pair of suction ports 32 for introducing operation fluid from the passage space 20*e* to the interior of the pump unit 22 are formed on each of the side plates 25 and 26 to be located at symmetric positions with resect to the rotary axis of the rotor 22*b*. Further, a pair of discharge ports 33 for discharging operation fluid from the pump unit 22 to the pressure chamber 27 are formed on the rear side plate 26 in such a manner that the discharge ports 33 are located at symmetric positions with resect to the rotary axis of the rotor 22*b* and are angularly offset by about 90 degrees from the suction ports 32 (see FIG. 4). Notably, FIG. 3 shows a cross section taken along line III—III in FIG. 4 in order to show both the suction ports 32 and the discharge ports 33.

A valve bore 35 of a flow control valve 34 is formed in the rear housing 20*b* coaxially with the rotary axis of the rotor 22*b*. The front end of the valve bore 35 communicates with the pressure chamber 27, and the rear end of the valve bore 35 is closed. A bypass passage 36 is formed in the housing 20 along a plane which includes the rotary axis of the rotor 22*b* and perpendicularly intersects a line connecting the suction ports 32, to thereby establish communication between an axially intermediate portion of the wall surface of the valve bore 35 and the passage space 20*e*. The bypass passage 36 is formed by first and second passages 36*a* and 36*b* formed in the rear housing 20*b* to intersect each other perpendicularly, a corner guide 36*d* fitted into the first passage 36*a* in a fluid-tight manner and smoothly connecting the passages 36*a* and 36*b*, and a third passage 36*c* formed in the front housing 20*a*. A suction passage 37 for receiving operation fluid from a reservoir (not shown) is connected to the first passage 36*a* at a position 36*e* on the pressure chamber 27 side and in proximity to the valve bore 35.

A spool valve body 38 for opening and closing the bypass passage 36 is slidably fitted into the valve bore 35 of the flow control valve 34, and is elastically urged toward the pressure chamber 27 by means of a spring 39 disposed between the spool valve 38 and the bottom surface of the valve bore 35. When the flow control valve 34 does not operate, the spool valve body 38 is stopped at the advanced position at which a protrusion 38*a* coaxially extending from the tip end of the spool valve body 38 abuts the rear side plate 26. Thus, the flow control valve 34 is closed. In this state, the tip end of the spool valve body 38 is located rearward from the bottom surface of the depression 20*g* defining the pressure chamber 27, so that a relatively large space is formed at the center portion of the pressure chamber 27. A communication passage 41 having a throttle portion is formed in the rear housing 20*b* in order to connect a discharge passage 40 located on the downstream side of the metering orifice 29 and the space in the valve bore 35 located on the rear side of the spool valve body 38.

The pulley 23 has a boss portion 23*a* and a rim portion 23*b*, which are formed integrally to be coaxial with each other. The boss portion 23*a* is fixed to one end of the pump shaft 21 projecting from the front end portion 20*c* of the front housing 20*a*. The rim portion 23*b* is axially offset a relative to the boss portion 23*a* in order to cover a most portion of the front end portion 20*c* of the front housing 20*a*, which supports the ball bearings 24. A groove portion 23*c* (drive force input portion) consisting of a plurality of V grooves is formed on the outer circumference of the rim portion 23*b*. An unillustrated drive belt is extended between and wound around the groove portion 23*c* of the pulley 23 and an unillustrated pulley attached to an output shaft of an engine of a vehicle. In the present embodiment, a plane L passing though the widthwise center of the groove portion 23*c* (hereinafter referred to as the "widthwise center plane L") is located at the midpoint between the centers of balls of one bearing 24 and the centers of balls of the other bearing 24.

When rotation of the output shaft of the engine is transmitted to the pump shaft 21 via the drive belt and the pulley 23, the rotor 22*b* of the pump unit 22 rotates. As a result, operation oil introduced from the unillustrated reservoir to the suction passage 37 flows into the spaces between the vanes 22*d* of the pump unit 22 via the bypass passage 36, the passage space 20*e*, and the suction ports 32. When the rotational speed of the pump shaft 21 is low, the flow control valve 34 maintains the closed state, so that the entirety of the operation fluid is supplied from the outlet port 30 to, for example, a power steering apparatus via the metering orifice 29 and the discharge passage 40. When the flow rate of the operation fluid discharged from the outlet port 30 via the metering orifice 29 increases with the rotational speed of the pump shaft 21, the pressure difference across the metering orifice 29 increases accordingly. When the flow rate reaches a predetermined level, the pressure difference between the front and rear sides of the spool valve body 38 reaches a predetermined level, and the spool valve body 38 retracts against the spring 39. As a result, the flow control valve 34 opens, and the operation oil within the pressure chamber 27 returns to the suction ports 32 of the pump unit 22 via the bypass passage 36 and the passage space 20*e*. Specifically, when the rotational speed of the pump shaft 21 increases and the flow rate of the operation fluid discharged from the outlet port 30 is about to increase, the spool valve body 38 retracts accordingly in order to increase the opening of the flow control valve 34 to thereby increase the return flow. Through this automatic regulation, the flow rate of the operation fluid discharged from the outlet port 30 is maintained substantially constant.

In the above-described first embodiment, the groove portion 23*c* around which a drive belt is wound is disposed such that the widthwise center plane L of the groove portion 23*c* is located at the midpoint between the centers of balls of one bearing 24 and the centers of balls of the other bearing 24. The tensile force W which the drive belt applies to the pulley 23 in a direction perpendicular to the axial direction is born equally by the two ball bearings 24, so that the force acting on each ball bearing 24 becomes half the tensile force W. Therefore, ball bearings having a small load capacity can be used as the ball bearings 24. Further, since no moment which inclines the pump shaft 21 supported by the ball bearings 24 is produced, the distance between the two bearings 24 can be reduced. Therefore, the overall size of the pump apparatus can be reduced through a reduction in size of the tip end portion 20*c* of the front housing 20*a*, which supports the ball bearings 24. Moreover, since the ball bearings 24 are disposed within the tip end portion 20*c* of the front housing 20*a* to be located adjacent to each other, misalignment between the respective centers of the ball bearings 24 does not occur. Therefore, rotation of the pump shaft 21 does not become unsmooth.

Figure 1:
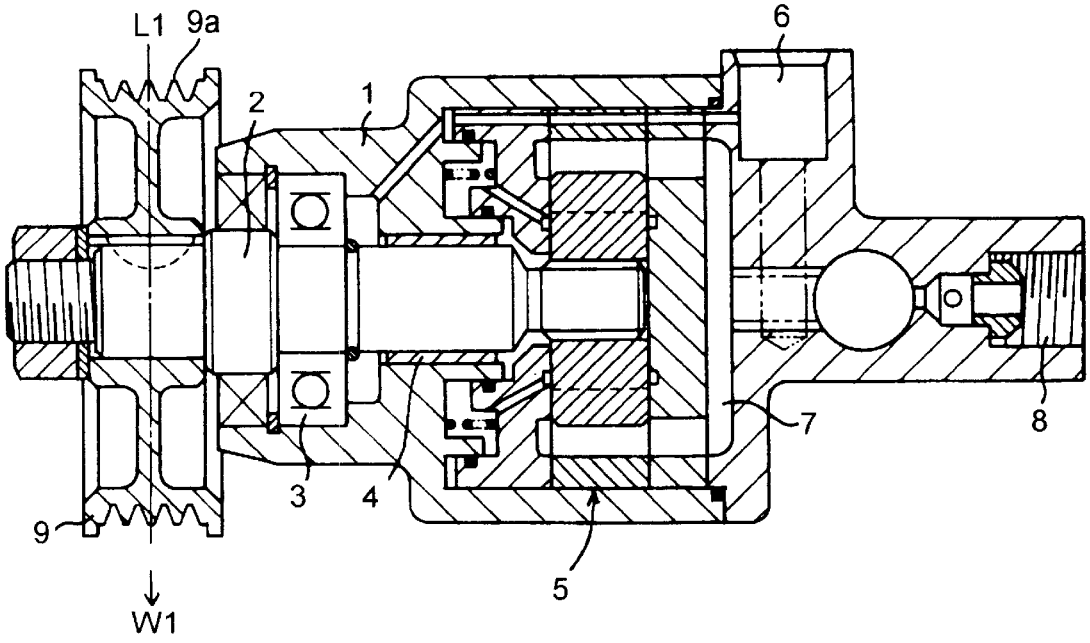
Fig. 1 Conventional Art
FIG. 1 is a cross-sectional view of a conventional pump apparatus.
Figure 2:
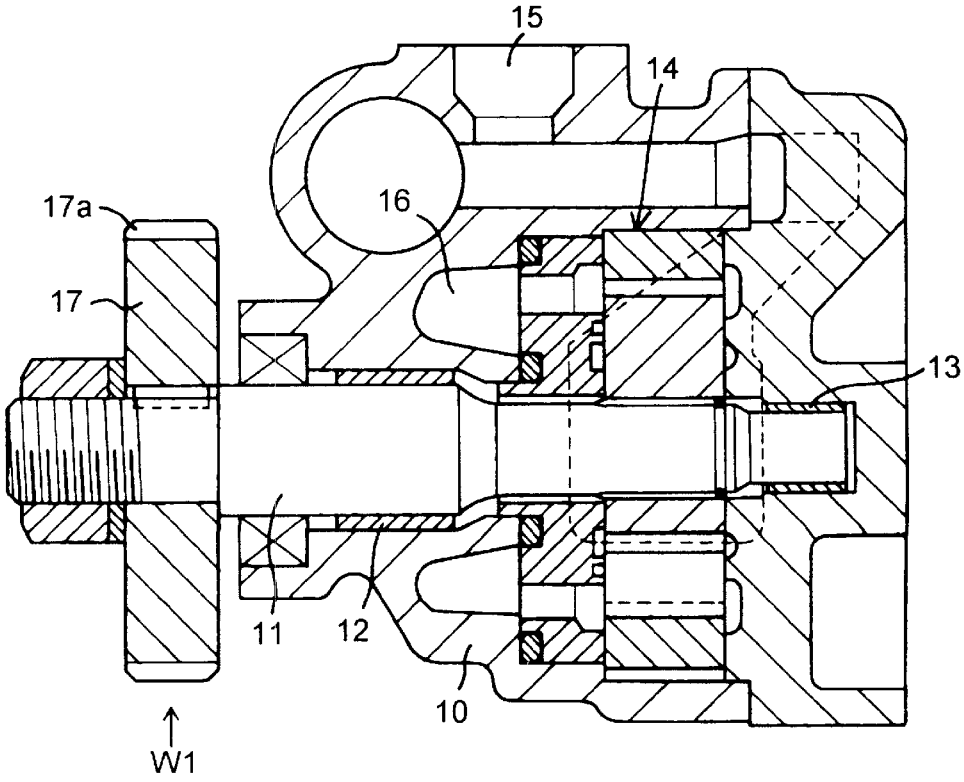
Fig. 2 Conventional Art
FIG. 2 is a cross-sectional view of another conventional pump apparatus.

In the above-described embodiment, since the widthwise center plane L of the groove portion 23*c* around which a drive belt is wound is located at the midpoint between the centers of balls of one bearing 24 and the centers of balls of the other bearing 24, the force acting on each ball bearing 24 becomes half the tensile force W. However, the present. invention is not limited thereto; the widthwise center plane L of the groove portion 23*c* may be located at any other point between the centers of balls of one bearing 24 and the centers of balls of the other bearing 24. In such a case, the force or load does not act equally on the two ball bearings 24, and one of the ball bearings 24 receives a larger force or load than does the other ball bearing 24. However, the larger force or load is smaller than the tensile force W. Moreover, a moment which inclines the pump shaft 21 supported by the ball bearings 24 is not produced. Accordingly, as compared with the conventional pump apparatuses' shown in FIGS. 1 and 2, smaller ball bearings having a smaller load capacity can be used for the ball bearings 24, and the distance between the ball bearings 24 can be reduced. Therefore, the size of the tip end portion 20*c* of the front housing 20*a* supporting the ball bearings 24 can be reduced in order to reduce the overall size of the pump apparatus. In the above-described embodiment, although the two ball bearings 24 are used to support the pump shaft 21, the bearings 24 are not limited to the ball bearings. Slide bearings or needle roller bearings can be used for the bearings 24. In this case, the groove portion 23*c* is disposed such that its widthwise center plane L is located between the respective centers of the bearings. The number of bearings for supporting the pump shaft 21 is not limited to two. In the case in which a rolling bearing such as a double-row bearing or a slide bearing having a sufficient length is employed, a single bearing may be disposed, in which case the groove portion 23*c* is disposed such that its widthwise center plane L is located at the center of the bearing.

Figure 5:
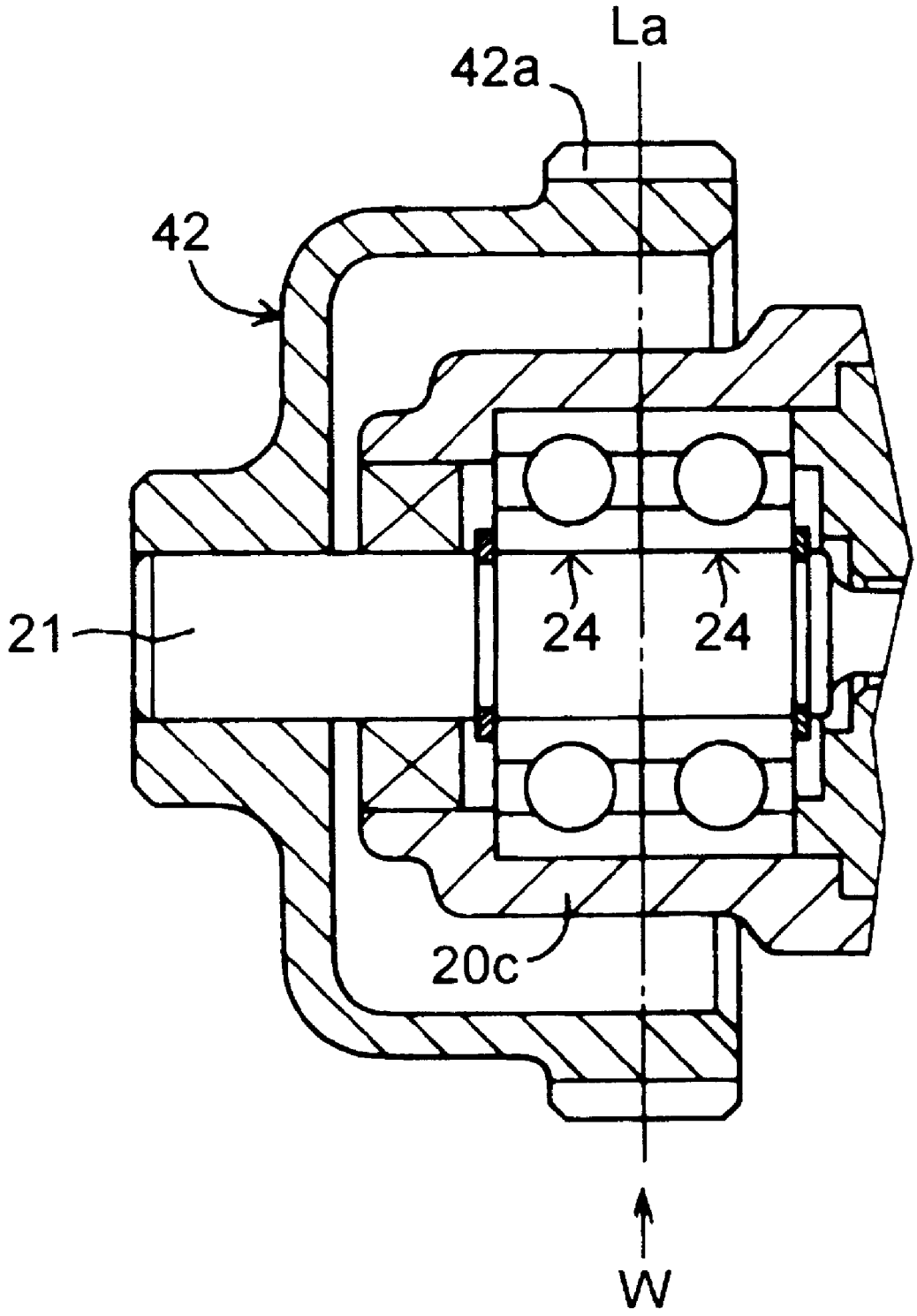
FIG. 5 is a cross-sectional view of a bearing support portion of a pump apparatus according to a second embodiment of the present invention.

FIG. 5 shows a second embodiment of the present invention. In the above-described first embodiment, the pulley 23 serves as a rotary drive member attached to one end of the pump shaft 21. The second embodiment differs from the first embodiment in that a gear 42 is used in place of the pulley 23. Although the gear 42 has substantially the same shape as that of the pulley 23, in place of the groove portion 23*c*, a tooth portion (drive force input portion) 42*a* is formed on the outer circumference. As in the first embodiment, the widthwise center plane La of the tooth portion 42*a* is located at the midpoint between the centers of balls of one bearing 24 and the centers of balls of the other bearing 24. In the second embodiment, the tooth portion 42*a* at the outer circumference of the gear 42 is in meshing engagement with a drive gear (not shown), which is driven by the engine of the vehicle. Thus, the pump shaft 21 is rotated by the engine. The tooth portion 42*a* of the gear 42 in meshing engagement with the drive gear is disposed such that its widthwise center plane La is located at the midpoint between the centers of balls of one bearing 24 and the centers of balls of the other bearing 24. By virtue of this arrangement, thrust force Wa which the drive gear applies top the tooth portion 42*a* in a direction perpendicular to the axial direction is born equally by the two ball bearings 24. Since the structure of the remaining portion, the action and effect, and the range of application are the same as those of the first embodiment, their repeated descriptions are omitted.

In the above-described embodiment, a balanced-type vane pump capable of canceling out radial forces acting on the pump shaft 21 is used as the pump unit 22. Such a balanced-type vane pump is suitable for the pump apparatus of the present invention which is designed in such a manner that the pump shaft 21 does not incline due to force (tensile force or thrust force) acting on the rotary drive member (the pulley 23 or the gear 42). However, the present invention is not limited thereto, and may be applied to a trochoid pump or a gear pump. Even in such a case, the above-described action and effects can be achieved.

In the pump apparatus according present invention, a moment which inclines the pump shaft is not generated, and thus a cantilever-type compact support structure can be employed to support the pump shaft. When two bearings are used to support the pump shaft, the distance between the two bearings can be reduced. Moreover, the tensile force or thrust force which the rotation drive member receives from a drive belt or drive gear is born by the two bearings, and the force or load acting on each bearing becomes smaller than that received by the rotation drive member. Accordingly, ball bearings having a small load capacity can be used to support the pump shaft. Further, when two bearings are used to support the pump shaft, the distance between the two bearings can be reduced. Therefore, the overall size of the pump apparatus can be reduced through a reduction in size of the tip end portion of the housing supporting the bearings. Moreover, when two bearings are used to support the pump shaft, the two bearings are disposed within the tip end portion of the housing to be located in close proximity to each other, so that misalignment between the respective centers of the ball bearings does not occur. Therefore, rotation of the pump shaft does not become unsmooth.

In the case in which the pump unit is a balanced-type vane pump, the pump unit does not apply radial force to the pump shaft, which radial force would otherwise hinder reduction in size of the pump apparatus.

Obviously, numerous modifications and variations of the present invention are possible in light of the above teachings. It is therefore to be understood that within the scope of the appended claims, the present invention may be practiced otherwise than as specifically described herein.

What is claimed is:

1. A pump apparatus which is driven by drive force from a drive source, said pump apparatus comprising:

a housing;

a bearing member provided within a tip end portion of said housing;

a pump shaft rotatably supported by said bearing member, a first end of said pump shaft projecting from said tip end portion of said housing;

a pump unit accommodated within said housing and operated through rotation of said pump shaft; and a drive member fixed to said first end of said pump shaft projecting from said housing and adapted to transfer drive force from said drive source to said pump shaft, wherein said drive member includes a boss portion fixed to said first end of said pump shaft projecting from said housing, and a rim portion integral with said boss portion, said rim portion being offset from said boss portion to cover at least a portion of said tip end portion of said housing, and said drive member includes a drive force input portion formed on an outer circumference of said rim portion, and to which said drive force is transferred from said drive source, a center of said bearing member in an axial direction of said pump shaft coinciding with a center of said drive force input portion in said axial direction of said pump shaft.

2. The pump apparatus according to claim 1, wherein said bearing member consists of two bearings disposed adjacent to each other; and said center of said drive force input portion in said axial direction of said pump shaft is located between respective centers of said two bearings in said axial direction of said pump shaft.

3. The pump apparatus according to claim 2, wherein said drive force input portion is a groove portion which is engaged with a drive belt extended between and wound around said groove portion and a pulley of said drive source; and a center of said groove portion is said axial direction of said pump shaft is located between said respective centers of said two bearings in said axial direction of said pump shaft.

4. The pump apparatus according to claim 2, wherein said drive force input portion is a tooth portion which is in meshing-engagement with a drive gear of said drive source; and a center of said tooth portion in said axial direction of said pump shaft is located between said respective centers of said two bearings in said axial direction of said pump shaft.

5. The pump apparatus according to claim 1, wherein said pump unit is a vane pump.

6. The pump apparatus according to claim 5, wherein said vane pump is a balanced-type vane pump having a plurality of suction ports disposed symmetrically with respect to said pump shaft and a plurality of discharge ports disposed symmetrically with respect to said pump shaft.

* * * * *